US005180506A

United States Patent [19]

Mulhorn

[11] Patent Number: 5,180,506

[45] Date of Patent: Jan. 19, 1993

[54] HOT TOP LINING ASSEMBLY FOR INGOT MOULDS

[75] Inventor: Fred M. Mulhorn, Strongsville, Ohio

[73] Assignee: Foseco International Limited, Birmingham, England

[21] Appl. No.: 760,135

[22] Filed: Sep. 16, 1991

[30] Foreign Application Priority Data

Oct. 2, 1990 [GB] United Kingdom ..... 9021406

[51] Int. Cl.[5] ..... B22D 7/10

[52] U.S. Cl. ..... 249/197; 249/106

[58] Field of Search ..... 164/359, 137; 249/106, 249/197, 198, 199, 200, 201, 202, DIG. 5

[56] References Cited

U.S. PATENT DOCUMENTS

| | | | |
|---|---|---|---|
| 1,258,209 | 3/1918 | Gathmann | 249/106 |
| 1,667,289 | 4/1928 | Gathmann | 249/106 X |
| 2,433,803 | 12/1947 | Woodworth | 249/197 |
| 2,914,825 | 12/1959 | Marburg | 249/198 |
| 3,318,564 | 5/1967 | LaBate | 249/197 |
| 3,447,772 | 6/1969 | LaBate | 249/197 |

FOREIGN PATENT DOCUMENTS

| | | |
|---|---|---|
| 1344180 | 1/1974 | United Kingdom . |
| 1431652 | 4/1976 | United Kingdom . |

*Primary Examiner*—J. Reed Batten, Jr.
*Attorney, Agent, or Firm*—Nixon & Vanderhye

[57] ABSTRACT

A hot top lining assembly for an ingot mould or for an ingot mould head box is made up of four boards of refractory material and fixed together by means of a guide bar incorporated in a wedge-shaped portion in the lateral edge of one of the boards mating with a slot in a lateral edge of an adjacent board.

11 Claims, 2 Drawing Sheets

HOT TOP LINING ASSEMBLY FOR INGOT MOULDS

Figure 1:
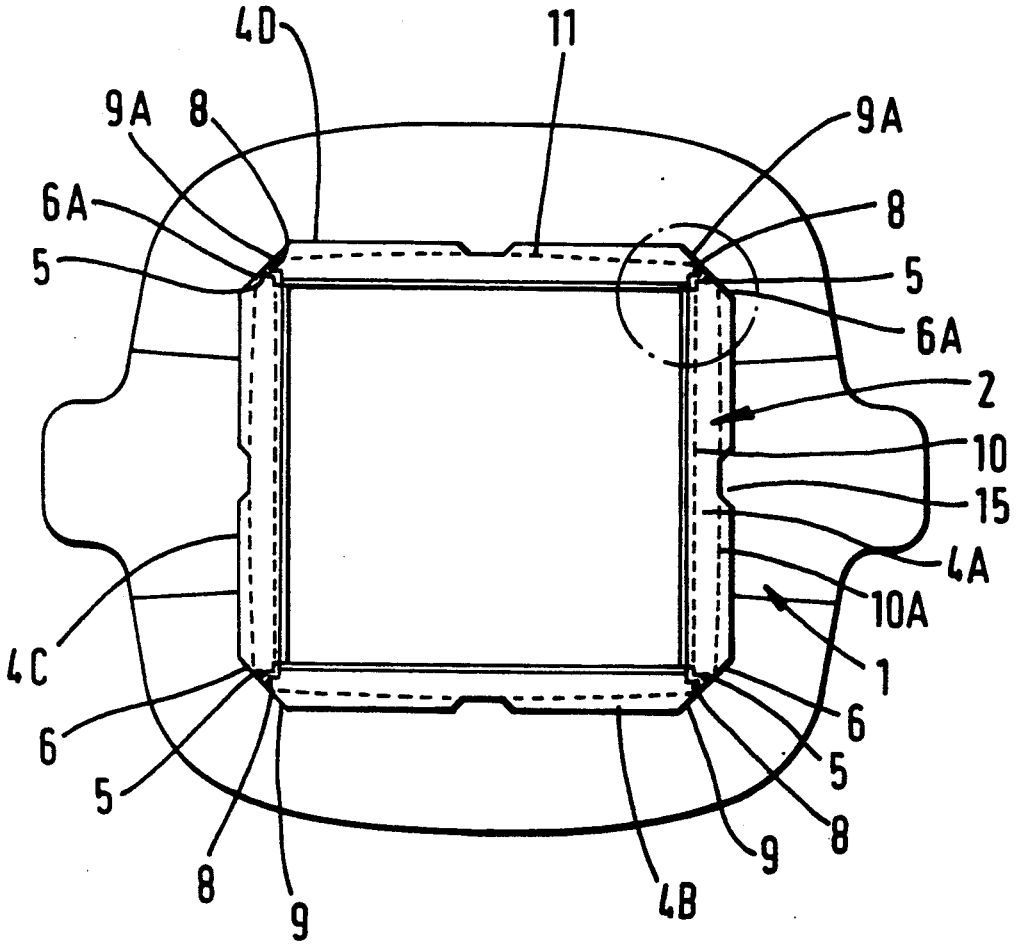

This invention relates to a hot top lining assembly for ingot moulds and ingot mould head boxes used in metal casting.

In the production of metal ingots, it is necessary to provide that the head metal of the ingot should not cool to solidification before the body of the ingot has solidified (as would be the normal tendency) because if this is allowed to occur molten metal cannot feed from the reservoir of the head metal to compensate for the shrinkage of the main body of metal and cavities, cracks or fissures, may form in the resulting ingot. It is accordingly customary to line the head of the ingot mould with boards of heat-insulating material or to provide on the ingot mould a separable head box which is lined with such boards.

Many methods of assembling hot top linings and holding them in place during casting have been proposed. Hot tops are commonly made up of four lining boards, and it is known to use four such boards in combination with four wedges which may be made of for example metal or of the same material as the four boards. Hammering such wedges into the corners of the moulds is a skilled operation if the wedges are not to be broken or if the possibility of the wedges being dropped into the ingot mould and becoming trapped in the cast ingot is to be avoided.

It would therefore be desirable to eliminate the need for the use of the corner wedges. However it has not been possible to produce an adequate hot top assembly from four lining boards alone, because the boards which are made by dewatering a slurry of refractory fibrous material, refractory particulate material and binder on to a suitable former cannot be formed to the accurate dimensions which would be needed to give the wedging action required.

It has now been found that a hot top assembly can be produced from four lining slabs without the need to use corner wedges by the incorporation of a guide bar in a lateral edge of a board and locating the guide bar in a slot in a lateral edge of an adjacent board.

According to the invention there is provided a hot top lining assembly for an ingot mould or for an ingot mould head box made up of four boards of refractory material and fixed together by means of a guide bar incorporated in a wedge-shaped portion in a lateral edge of one of the boards mating with a slot in a lateral edge of an adjacent board.

Although each of the four boards can have a wedge-shaped portion in one lateral edge and a slot in the other lateral edge it is preferred that two opposite boards have wedge-shaped portions in both lateral edges and that the other two boards have slots in both lateral edges.

In a much preferred embodiment the bars incorporated in the wedge-shaped portions of the board form two sides of a frame embedded in the board.

The hot top assembly of the invention may be used in any type of ingot mould, including a slotted mould, but it has particular application in square or rectangular moulds having a wall width of up to about 36 inches.

When the hot top assembly is to be used in a slotted mould it is desirable to reinforce the boards by the incorporation during manufacture of one or more grid structures such as metal mesh. This reinforcement strengthens the boards particularly in the region of the slot and enables the boards to withstand the head pressure of the metal poured into the mould.

The boards preferably have a ledge or lug at the top of the face which is to be in contact with the ingot mould or head box in use so that they can be located and held in position.

At least two of the boards which in use are located opposite each other may have elongate apertures which allow metal to protrude through the boards so that after casting the protrusions can be gripped by a crane to enable stripping of the ingot.

At least one of the boards may also have an aperture near to its upper edge so that completion of pouring of molten metal into the mould can be determined when metal passes through the aperture.

At least one of the moulds may also have an aperture or notch for hanging a bottom pouring flux located adjacent the bottom of the mould.

The boards may also have a recess in their face which is to be in contact with the mould to allow a stripping slug to be installed prior to pouring. The stripping slug holds the ingot away from the mould surface prior to stripping.

In order to ensure that the hot top assembly is driven back to the mould or head box wall it may be desirable to make the bottom of the boards having the wedge-shaped portion thicker than the top.

Assembly of the hot top in an ingot mould or head box is a simple operation. For example using two boards with wedge-shaped portions and guide bars and two boards with slots and setting lugs or ledges, the latter boards may be located in position using the lugs or ledges to set the boards at the required height. The other two boards are then pressed between the first two boards so that the guide bars engage with the slots to the same height in the ingot mould or head box.

Apart from eliminating the need for separate wedging corner pieces and therefore the problems associated with their use the hot top of the invention has an additional advantage in that the metal bars in the corners promote chilling of any metal which penetrates between the boards thereby eliminating excessive metal penetration and enabling metal to be poured above the height of the mould.

For example boards 12 inches in height could be inserted 6 inches into the mould and poured with metal 5 inches above the mould.

Figure 2:
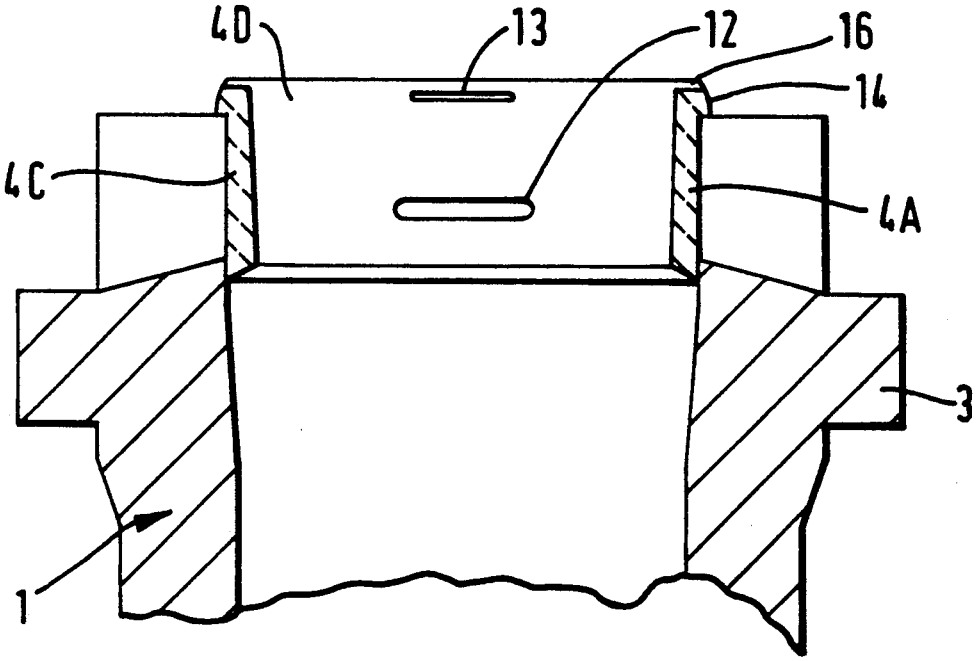
Figure 3:
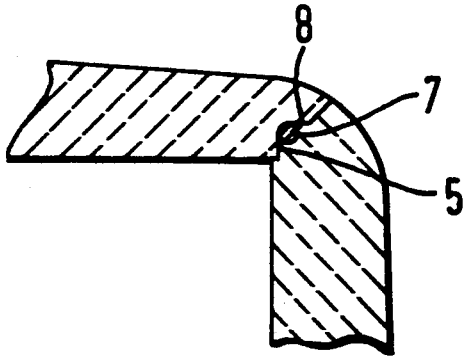

The invention is illustrated with reference to the accompanying drawings in which FIG. 1 is a top plan view of an ingot mould containing a hot top according to the invention, FIG. 2 is a vertical section of the top part of the ingot mould of FIG. 1 and FIG. 3 is an enlarged view shown in section of the part circled in FIG. 1.

Referring to the drawings an ingot mould 1 has a hot top assembly 2 according to the invention located at its top end 3. The hot top assembly 2 is made up of four boards 4A, 4B, 4C and 4D. Boards 4A and 4C have wedge-shaped portions 5 at both lateral edges 6, 6A and incorporated in the wedge-shaped portion 5 a metal guide bar 7. Boards 4B and 4D have a slot 8 in both lateral edges 9, 9A.

The guide bars 7 form two sides of a metal frame the other two sides of which are embedded in the boards 4A and 4C and extend across the width of the boards 4A and 4C near to their upper and lower edges. The boards 4A and 4C are also reinforced by means of two layers of metal mesh 10, 10A and the boards 4B and 4D are reinforced with one layer of metal mesh 11.

The boards 4B and 4D also have an elongate aperture 12 and another aperture 13 near to their upper edge.

All four boards 4A, 4B, 4C, and 4D have a lug 14 at the top of their face which is to be in contact with the ingot mould, and a recess 15 in the same face to allow insertion of a stripping slug when the hot top is assembled in a mould. The boards also have a through notch or aperture 16 for hanging a bottom pouring flux inside the mould.

The boards 4A and 4C are thicker at the bottom than at the top.

The hot top assembly 2 is produced by locating boards 4B and 4D in the desired position in the ingot mould 1 by means of lugs 14. The boards 4A and 4C are then inserted between 4B and 4D so that the guide bars 7 engage with the slots 8.

When metal is poured into the ingot mould 1 a small quantity passes through the elongate apertures 12 and on solidification forms protrusions which can be gripped to aid stripping of the cast ingot. A small quantity of metal also passes through apertures 13 indicating that casting of the ingot has been completed.

I claim:

1. A hot top lining assembly for an ingot mould or for an ingot mould head box made up of four boards of refractory material and fixed together by means of a guide bar incorporated in and along a wedge-shaped portion in a lateral edge of one of the boards mating with a slot in and extending along a lateral edge of an adjacent board.

2. A hot top lining assembly according to claim 1 wherein each of the four boards has a wedge-shaped portion in one lateral edge and a slot in the other lateral edge.

3. A hot top lining assembly according to claim 1 wherein two opposite boards have wedge-shaped portions in both lateral edges and the other two boards having slots in both lateral edges.

4. A hot top lining assembly according to claim 3 wherein the guide bars incorporated in and along the wedge-shaped portions of the boards form two sides of a frame embedded in the board.

5. A hot top lining assembly according to claim 1 wherein the boards are reinforced by one or more grid structures.

6. A hot top lining assembly according to claim 5 wherein the grid structure is a metal mesh.

7. A hot top lining assembly according to claim 1 wherein the boards have a ledge or a lug at the top of the face which is to be in contact with the ingot mould or head box in use.

8. A hot top lining assembly according to claim 1 wherein two opposite boards have elongate apertures therein.

9. A hot top lining assembly according to claim 1 wherein at least one of the boards has an aperture near to its upper edge.

10. A hot top lining assembly according to claim 1 wherein the boards have a recess in the face which is to be in contact with the ingot mould or head box in use.

11. A hot top lining assembly according to claim 1 wherein the boards having the wedge-shaped portion are thicker at the bottom than at the top.

* * * * *